US011738222B2

(12) United States Patent
Kirchner et al.

(10) Patent No.: US 11,738,222 B2
(45) Date of Patent: Aug. 29, 2023

(54) CONTROL DEVICE FOR OPERATING A FIRE EXTINGUISHER SYSTEM

(71) Applicant: IDEX Europe GmbH, Erlangen (DE)

(72) Inventors: Uwe Kirchner, Marloffstein (DE); Carsten Sauerbier, Lauf an der Pegnitz (DE)

(73) Assignee: IDEX EUROPE GMBH, Erlangen (DE)

( * ) Notice: Subject to any disclaimer, the term of this patent is extended or adjusted under 35 U.S.C. 154(b) by 127 days.

(21) Appl. No.: 16/633,521

(22) PCT Filed: Jul. 28, 2017

(86) PCT No.: PCT/EP2017/069117
§ 371 (c)(1),
(2) Date: Jan. 23, 2020

(87) PCT Pub. No.: WO2019/020191
PCT Pub. Date: Jan. 31, 2019

(65) Prior Publication Data

US 2020/0230452 A1 Jul. 23, 2020

(51) Int. Cl.
*A62C 35/68* (2006.01)
*A62C 35/62* (2006.01)

(52) U.S. Cl.
CPC ..... *A62C 35/68* (2013.01); *A62C 35/62* (2013.01)

(58) Field of Classification Search
CPC ..... A62C 35/68; A62C 35/62; A62C 31/005; A62C 37/50; A62C 27/00
See application file for complete search history.

(56) References Cited

U.S. PATENT DOCUMENTS 5,764,463 A 6/1998 Arvindson et al.
6,973,975 B1 12/2005 Adamson et al.
(Continued)

FOREIGN PATENT DOCUMENTS

CN 202355740 U 8/2012
DE 8710073.8 U1 9/1987
(Continued)

OTHER PUBLICATIONS

International Search Report and Written Opinion of the International Searching Authority for International Patent Application No. PCT/EP2017/069117 dated Jun. 4, 2018, 17 pages.
Japanese Examination Report for Japanese Patent Application No. 2020-526672 dated Apr. 6, 2021, 6 pages.
International Preliminary Report on Patentability for corresponding International Patent Application No. PCT/EP2017/069117 dated Feb. 6, 2020, 11 pages.

*Primary Examiner* — Qingzhang Zhou
*Assistant Examiner* — Joel Zhou
(74) *Attorney, Agent, or Firm* — Panitch Schwarze Belisario & Nadel LLP

(57) ABSTRACT

A control device for operating a fire extinguisher system includes at least one hose (3) having an extinguisher nozzle (4) arranged at the end of the hose (3) to be operated by an operator for releasing a pressurized extinguishing fluid. A conveying pump (5) conveys the pressurized extinguishing fluid in the hose (3) towards the extinguisher nozzle (4). A first supply line (7) connects the conveying pump (5) to a tank (8) of a fire extinguisher device, such as a fire extinguisher vehicle (1). A second supply line (9) connects the conveying pump (5) to a stationary extinguishing fluid source (2). A multi-port switch valve (10) connects upstream of the conveying pump (5), proximate the first supply line (7) and second supply line (9).

5 Claims, 6 Drawing Sheets

(56) References Cited

U.S. PATENT DOCUMENTS

| | | | | |
|---|---|---|---|---|
| 7,886,837 | B1 * | 2/2011 | Helfgott | A62C 35/68 169/5 |
| 8,418,773 | B2 | 4/2013 | Cerrano | |
| 9,220,935 | B2 | 12/2015 | Cerrano | |
| 10,532,237 | B2 * | 1/2020 | Reilly | B05B 7/066 |
| 2005/0252664 | A1 * | 11/2005 | Clum | A62C 35/62 169/17 |
| 2012/0061108 | A1 | 3/2012 | Cerrano | |
| 2012/0103435 | A1 * | 5/2012 | Laskaris | F16K 24/04 137/467.5 |
| 2012/0132445 | A1 | 5/2012 | Mallon et al. | |
| 2016/0096053 | A1 * | 4/2016 | Beechy | A62C 37/36 169/46 |

FOREIGN PATENT DOCUMENTS

| | | | |
|---|---|---|---|
| DE | 88 08 931 | U1 | 10/1988 |
| DE | 689 02 671 | T2 | 3/1993 |
| DE | 35 17 284 | C2 | 6/1996 |
| DE | 10 2008 004 785 | A1 | 7/2009 |
| DE | 20 2015 002 738 | U1 | 5/2015 |
| EP | 0 990 453 | A1 | 4/2000 |
| JP | H07-75679 | A | 3/1995 |
| JP | H08-47548 | A | 2/1996 |
| WO | 95/07526 | A1 | 3/1995 |

* cited by examiner

CONTROL DEVICE FOR OPERATING A FIRE EXTINGUISHER SYSTEM

This application is a National Stage Application of PCT/EP2017/069117, filed 28 Jul. 2017, and which application is incorporated herein by reference. To the extent appropriate, a claim of priority is made to the above-disclosed application.

DISCUSSION OF BACKGROUND

During a fire-fighting operation, the fire extinguisher vehicle is first moved into position and the fire is first fought with extinguishing fluid, which is located in a tank of the fire extinguisher vehicle. This makes it possible to begin the fire-fighting operation as quickly as possible. At the same time, because the tank only allows for a limited volume and thus only a limited time of extinguishing, another source of extinguishing fluid is sought. These sources are usually fixedly installed hydrants, streams or lakes. They provide an unlimited volume of extinguishing fluid. However, locating and connecting a suitable source of extinguishing fluid to the fire extinguisher system of the fire extinguisher vehicle requires a certain amount of time.

Using the fire extinguisher nozzle at the end of the water hose, the firefighter fights the fire by spraying extinguishing fluid onto the fire under high pressure. If the firefighter intends to back away from the fire, the fire extinguisher nozzle can be actuated in such a way that the extinguishing fluid no longer exits the fire extinguisher nozzle without deflection but rather forms a wall of extinguishing fluid that protects the firefighter against impairment by flames and/or heat when retreating. If the firefighter is no longer capable of forming a wall of extinguishing fluid due to an abrupt interruption of the extinguishing fluid supply, it presents a considerable danger to the life and limb of the firefighter. As a result, the firefighter must always be aware of how much extinguishing fluid remains in the tank and whether a connection to another source of extinguishing fluid is already available. This is the only way of ensuring that the firefighter is still able to back away from the fire in time in an emergency.

During operation, putting one or even a plurality of further extinguisher nozzles into operation that are all supplied from the tank for extinguishing fluid via a conveying pump can increase the risk even further. This is because doing so can cause the emptying rate of the extinguishing fluid tank to abruptly increase. In this regard, the firefighter may no longer have the time required to form the wall of extinguishing fluid.

Extinguishing fluid is extinguishing water or a mixture of extinguishing water and an additive in the form of foam or the like.

PRIOR ART LITERATURE

A control device for operating a fire extinguisher system according to the preamble of claim 1 is known, for example, from DE 689 02 671 T2. This known control device comprises a cable communication system having a transmission line positioned in the water hose for a communication link between a firefighter standing at the leading end of the water hose and the operating personnel at the fire truck. In particular, the cable communication system is intended to make voice communication possible. For this purpose, a receiver and a microphone are accommodated in the helmet of the firefighter. The firefighter is thus exclusively dependent on the cable communication with the operating personnel at the fire truck. This idea is therefore intended to improve the voice communication between the firefighter and the operator. If said voice communication is not available for whatever reason, even briefly, there is an increased risk for the firefighter at the fire.

EP 990 453 A1 shows a fire extinguisher device having an extinguishing gun that is connected to a high-pressure apparatus via a hose. The end of the hose opposite the extinguishing gun is connected to two chambers via a three-way valve, the one chamber accommodating extinguishing water free of foaming agents and the other chamber accommodating a mixture of water and foaming agents. An actuating device is provided on the extinguishing gun, which actuating device is connected to an electrical line integrated into the hose, which electrical line has a base.

G 87 10 073.8 shows a foam proportioning device for firefighting having a foaming agent tank, a water tank and an inlet port for a hydrant, lake or river. A changeover valve having a pivotable butterfly valve is provided in the region of the inlet port.

A control device for a fire extinguisher device having a control panel arranged in the interior or on the exterior of a fire-fighting vehicle is known from U.S. Pat. No. 7,987,916 B2. Using the control panel, the firefighter can select various operating modes for the fire extinguisher device. In addition, the control device comprises a device for defining a pressure of a conveying pump connected to the tank. If the tank is empty, a warning signal is output to the operator at the control panel.

WO 95/07526 shows an electro-optical device for generating a real operation scene when fighting fires. The device comprises a video camera, which can be accommodated in the helmet of a firefighter. The recorded data is transmitted to a data center. There, the transmitted data is combined with the stored data, for example precise position data, to support the fire-fighting operation.

DE 10 2008 004 785 A1 describes a portable system for protecting and guiding firefighters in buildings. The system comprises, among other things, an infrared camera for recording thermal imaging data as well as a display device. The display device can be accommodated in the helmet of the firefighter as a head-up display. The data is transmitted directly from the thermal imaging camera to the head-up display by radio.

A fire extinguisher device having an extinguishing gun connected via an extinguishing agent hose is known from DE 20 2015 002 738 U1, a sensor in the form of a thermal imaging camera or another thermal detection device being mounted on the extinguishing gun and the optical axis of the sensor extending approximately parallel to the nozzle tube axis of the extinguishing agent gun. The sensor can be connected via a radio connection by means of an antenna having a receiving device. The receiving device can be either a display arranged on the extinguishing gun or an image forming device worn by the firefighter on their helmet to which the data is transmitted via a radio connection.

DE 35 17 284 C2 describes a device for delivering an extinguishing agent mixed with an additive. The device comprises an extinguishing agent gun at the end of a hose line on which a pushbutton is arranged with which the firefighter operating the extinguishing gun can directly activate a premixer for adding additives to the extinguishing agent. The pushbutton is connected to a control device via lines positioned in the hose line.

In the control system for firefighting described in U.S. Pat. No. 8,418,773 B2, the firefighter standing at the end of the hose line operates a display and control panel, which is connected to a base station located in the fire-fighting vehicle via radio. The display and the control panel make it possible for the firefighter to control the supply of extinguishing agent alone, i.e., without the help of an additional person at the fire-fighting vehicle. However, transmission via radio is frequently subject to disturbances that may result in considerable risk to the firefighter, in particular if, for example, a fire is located inside a building and reinforced concrete floors impede radio transmission. The firefighter must disconnect the tank when the tank is empty.

Furthermore, U.S. Pat. No. 9,220,935 B2 discloses a nozzle for firefighting having a display provided directly on the nozzle for displaying various parameters. The display is connected to remote components in a communication-capable manner. The water volume present in the water tank is shown on the display on the one hand and on the other hand, the water pressure in the supply line to the stationary water reservoir is shown. By being aware of the quantity of water, the firefighter is forced to calculate the remaining amount of time that will pass until the tank is empty. Furthermore, the emptying rate of the tank can suddenly increase if an additional extinguisher hose is supplied with extinguishing fluid via the tank. In addition, the firefighter at the first extinguishing fluid hose does not know how intense the consumption of extinguishing fluid will be in the extinguishing fluid hose that has just been put into operation.

Object of the Present Invention

The object of the present invention is to provide a new, generic control device for operating a fire extinguisher system that provides increased safety for the firefighter at the extinguisher nozzle with simple design implementation.

Achievement of the Object

The fact that the first supply line to the tank and the second supply line to the stationary extinguishing fluid source are connected to a multi-port valve upstream of the conveying pump means that the extinguishing fluid stream can switch from the tank to the stationary extinguishing fluid point in an automated manner. This eliminates the need for the firefighter to monitor valves in the supply lines of the conveying pump and to switch off the respective feeds. The switchover can take place automatically with the multi-port valve without the need for human intervention in the process as an operator.

The multi-port valve according to the invention is expediently a pressure-controlled multi-port valve.

The basic position of the multi-port valve connects the conveying pump to the tank. In contrast, the multi-port valve can be controlled via the pressure present at the multi-port valve in the second supply line to the stationary fluid source.

Thus, in the basic position of the multi-port valve, the tank is initially emptied while the fire extinguisher system is in operation and, if the defined pressure is present at the multi-port valve in the second supply line, the supply of extinguishing fluid from the tank is switched away from the tank and to the stationary extinguishing fluid source.

The fact that the pressure present at the multi-port valve in the second supply line can be defined with a separate pump means that the pressure control of the multi-port valve can also be used if the extinguishing fluid originating from the stationary extinguishing fluid source is not under pressure (as is the case with a hydrant, for example) but rather needs to be sucked in.

The multi-port valve is expediently switched over at a pressure threshold value that can be adjusted.

The multi-port valve is expediently a multi-port valve, the pressure-dependent switching point of which is defined by an elastic element, for example a spring, and/or by magnetic means.

Alternatively, the multi-port valve can also have a motor drive that can be controlled by the controller when the switching conditions are met.

If necessary, the switching position of the multi-port valve can expediently also be displayed on a display located in the region of the extinguisher nozzle or the firefighter operating said extinguisher nozzle.

Preferably, a return line can be provided from the conveying pump to the tank, which return line makes it possible for a certain percentage of the quantity of extinguishing fluid conveyed to be returned to the tank while extinguishing fluid is being obtained from the stationary extinguishing fluid source, as a result of which said tank can be refilled during the fire-fighting operation.

The fact that the multi-port valve is connected via control lines to a controller serving as an operations center means that the switching position of the multi-port valve can be centrally monitored and/or, if necessary, even be controlled.

The multi-valve port is advantageously designed as a switch valve.

The present invention relates to, and claims in a coordinate manner, a multi-port valve for a control device for operating a fire extinguisher system having

- a first extinguishing fluid connector for connection to an extinguishing fluid line to a tank of a fire extinguisher device, in particular a fire extinguisher vehicle,
- a second extinguishing fluid connector for connection to an extinguishing fluid line to a stationary extinguishing fluid source in the region of the fire extinguisher device, in particular the fire extinguisher vehicle,
- a third extinguishing fluid connector for connection to an extinguishing fluid line to a conveying pump.

DESCRIPTION OF THE INVENTION ON THE BASIS OF EMBODIMENTS

Expedient embodiments of the present invention will be explained in greater detail below with reference to drawings. In the drawings.

Figure 4A:
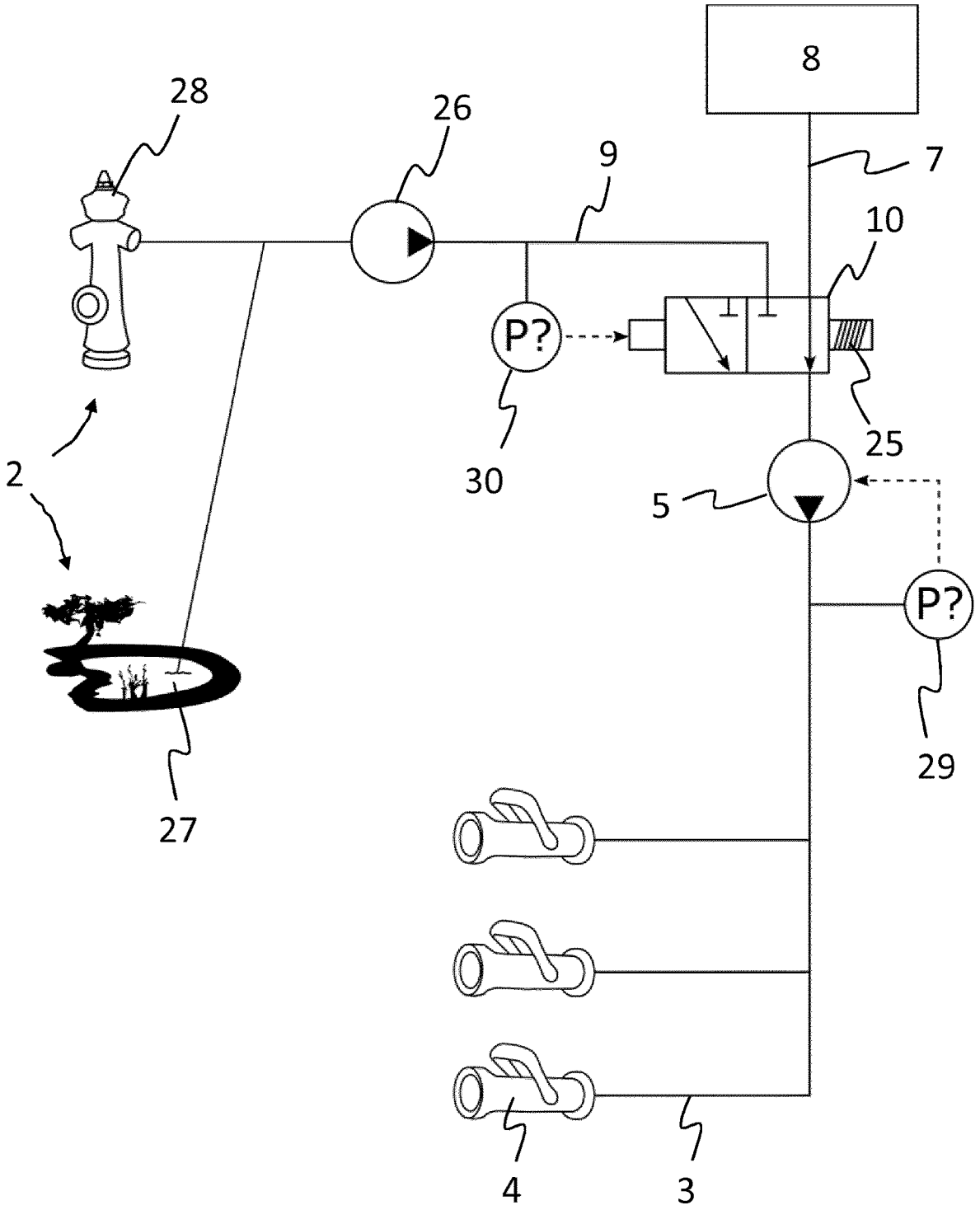
Figure 4B:
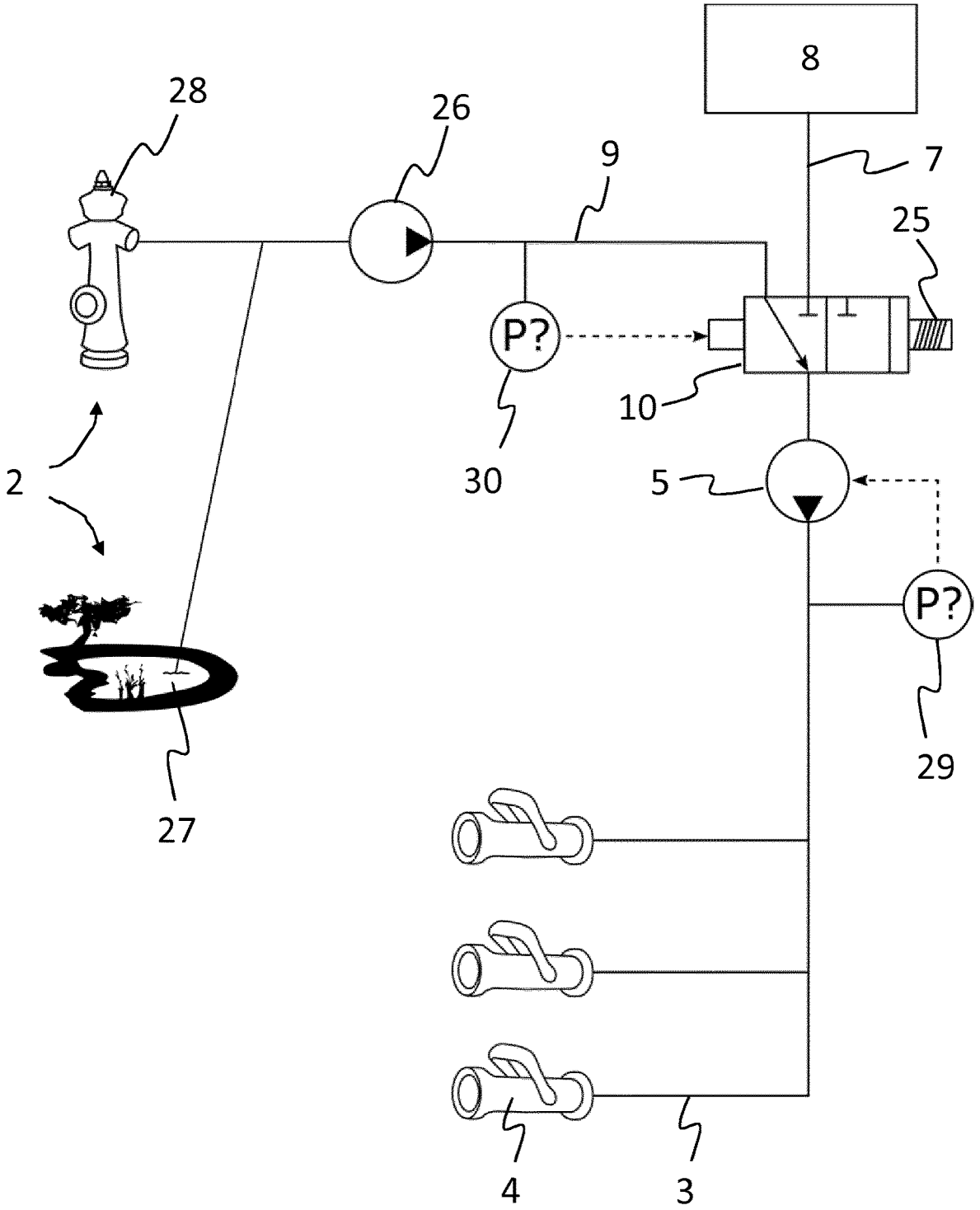
Figure 5:
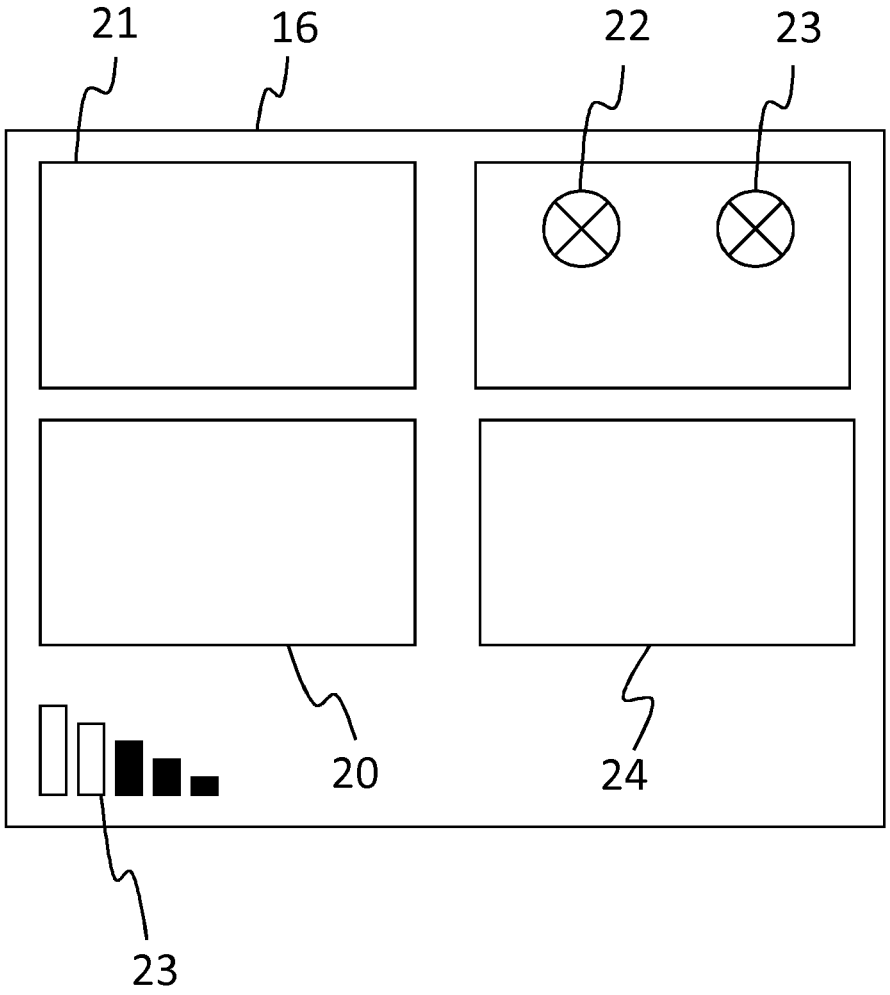

FIG. 4*a*-4*b* a show highly simplified schematic representations of the use of a multi-port switch valve, namely in the switching position for conveying extinguishing fluid from the tank (FIG. 4*a*), and in the switching position of conveying extinguishing fluid via the stationary extinguishing fluid source (FIG. 4*b*); and FIG. 5 shows a highly simplified schematic representation of the display in the display device carried by the firefighter.

Figure 1:
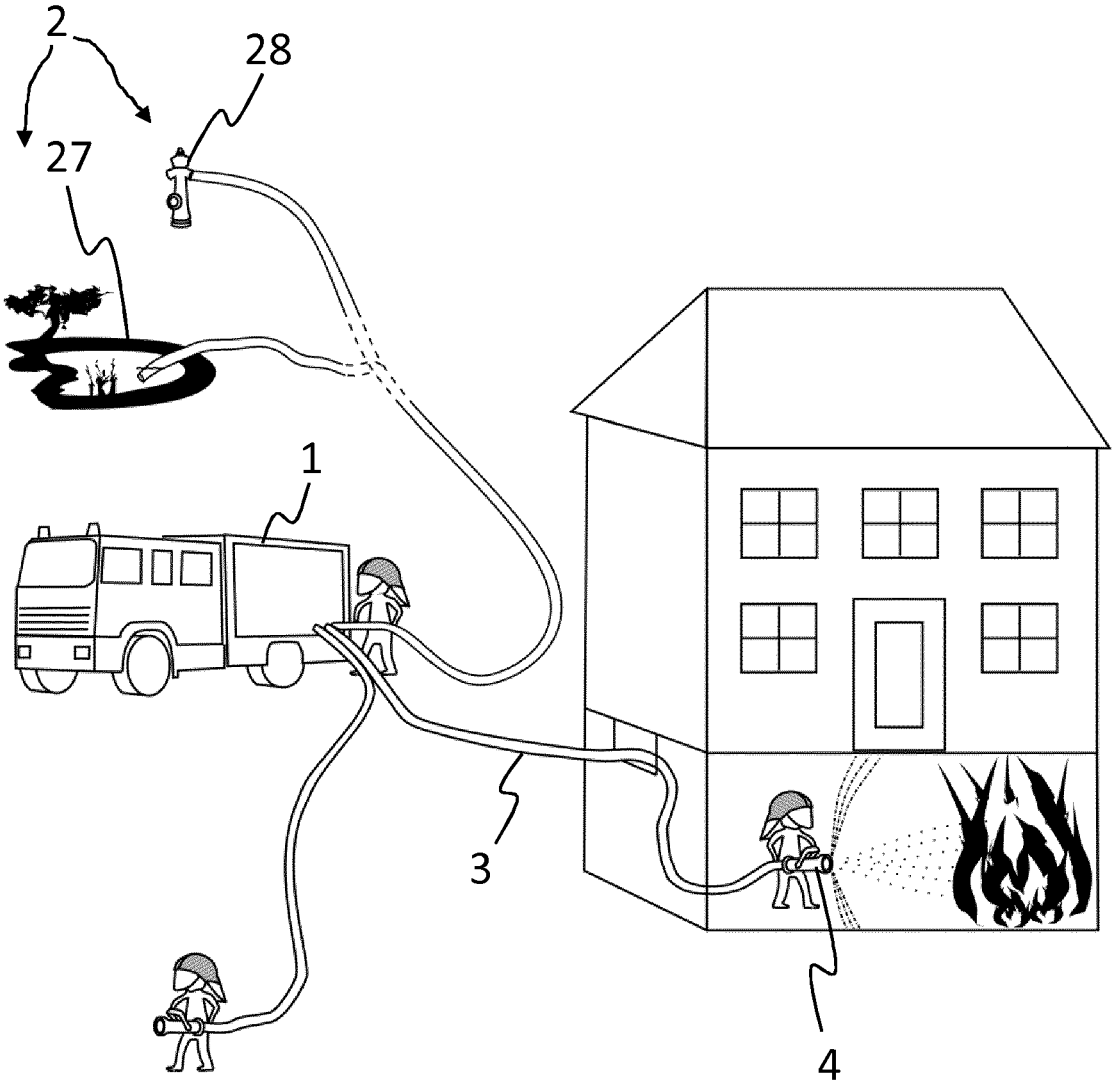
FIG. 1 shows a highly simplified representation of a typical fire-fighting situation.

FIG. 1 shows a typical fire-fighting situation involving the fighting of a fire that has broken out in the basement of a building. After the fire-fighting vehicle 1 arrives, a firefighter enters the basement of the building with the hose 3 and releases extinguishing fluid via the extinguisher nozzle 4 for immediate firefighting. In this case, the extinguishing fluid is obtained from a tank located in the fire-fighting vehicle 1. As a result of this, it is possible to start fighting the fire as soon as the fire-fighting vehicle 1 has arrived. At the same time, further firefighters search for an unlimited extinguishing fluid source 2, such as a hydrant, a lake 27 or a stream, in the surrounding area. A considerable amount of time can pass here. As soon as an unlimited extinguishing fluid source has been found, it is connected to the fire-fighting vehicle 1 via a supply line. The hose 3 located at the fire can then be supplied with extinguishing fluid from the unlimited extinguishing fluid source.

For fighting fires, a plurality of hoses is usually provided in a fire-fighting vehicle 1, which hoses can also be used simultaneously if necessary. For the sake of clarity, FIG. 1 only shows a second hose having an extinguisher nozzle arranged at its end. This extinguisher nozzle is operated by a further firefighter.

To fight a fire, the firefighter can manually adjust the extinguisher nozzle 4 in such a way that the extinguisher nozzle 4 release the extinguishing fluid at a low opening angle. As a result, it is possible to achieve a maximum extinguishing effect on the fire. If, however, the fire spreads despite the fire fighting and threatens the firefighter, the firefighter can manually adjust the extinguishing nozzle 4 in such a way that the extinguisher nozzle 4 releases the extinguishing fluid at a very large opening angle. As a result, the firefighter can protect him or herself from fire and/or intense heat and safely exit the building. Both operating modes of the extinguisher nozzle 4 are shown schematically in FIG. 1. If the supply of extinguishing fluid is unexpectedly interrupted, the firefighter can suddenly end up in a life-threatening situation because he or she can no longer release the extinguishing fluid at a very large opening angle to protect him or herself.

Figure 2:
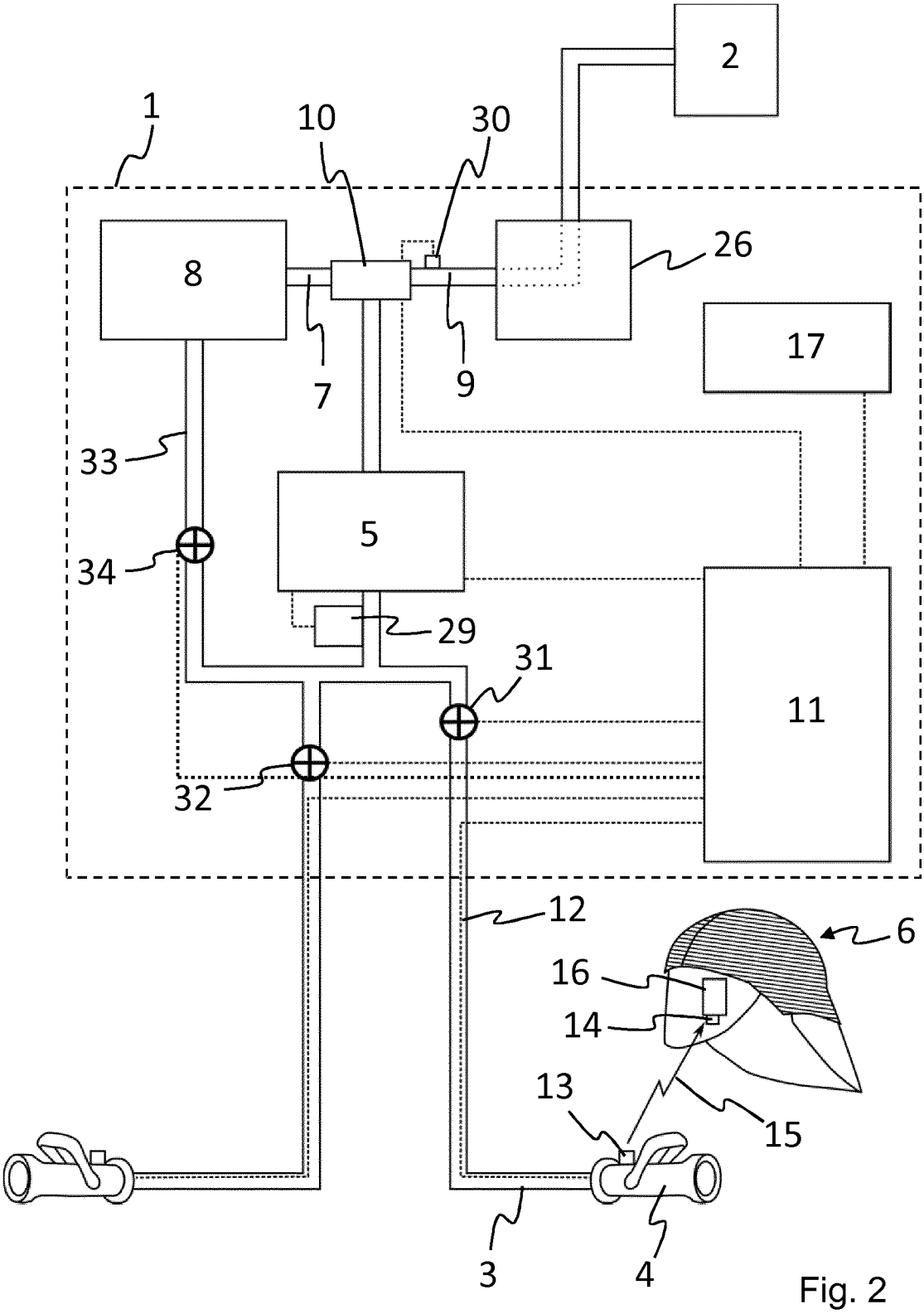
FIG. 2 shows a highly simplified schematic representation of a control device according to the present invention.

FIG. 2 shows a simplified basic circuit diagram of the control device according to the invention. The components illustrated within the dashed line are, in this case, preferably located in the region of the fire extinguisher device, i.e., in the region of the fire-fighting vehicle 1. The components comprise a controller 11 having a plurality of control and/or signal lines (dotted lines) that are connected to various functional components of the system as a whole. In particular, the tank 8 for providing extinguishing fluid directly at the fire-fighting vehicle 1 is shown. The tank 8 is connected to the conveying pump 5, for example a centrifugal pump, via a first supply line 7.

In addition, a second supply line 9 is provided that is connected to a supply line and supplies the conveying pump 5 with extinguishing fluid from the stationary extinguishing fluid source 2.

The first supply line 7 and the second supply line 9 lead into a multi-port valve 10, which is preferably pressure-controlled, upstream of the conveying pump 5. The multi-port valve 10 thus ensures independently of the pressure present at the second supply line 9 that the inflow to the conveying pump 5 is switched over from the tank 8 to the stationary extinguishing fluid source 2. The pressure control 30 of the multi-port valve 10 is shown only schematically in FIG. 2.

The hose 3, at the end of which a portable extinguisher nozzle 4 is located, is supplied with extinguishing fluid via the conveying pump 5. For the sake of clarity, only a single additional hose having an extinguisher nozzle is shown in FIG. 2. However, a plurality of extinguisher nozzles and corresponding hoses, which are supplied with extinguishing fluid via the conveying pump 5, can, if necessary, also be provided. A valve 31, 32 is located in the region of each supply line to the extinguisher nozzle, which valve is connected to the controller 11 via a control and/or signal line and can be actuated via the controller 11.

The outlet of the conveying pump 5 is also connected to a return line 33 via which extinguishing fluid from the stationary extinguishing fluid source 2 can be returned to the tank 8 to refill it, this process being controlled via a valve 34 connected to the controller 11.

Reference numeral 29 designates a device for conveying pump control or a so-called "pressure governor". Said pressure governor is capable of adjusting the pumping capacity to the required quantity of extinguishing fluid to be delivered. If, for example, a drop in pressure is caused by a further hose or a further extinguisher nozzle, the device 29 for conveying pump control controls the pumping capacity in such a way that the latter is raised to adjust the conveying pressure of extinguishing fluid in the respective hose to the previous level again.

Reference numeral 26 in FIG. 2 designates a further pump that is provided to define the pressure conditions in the second supply line 9 from the stationary extinguishing fluid source 2 to the conveying pump 5, unless an extinguishing fluid source 2 that is not under pressure has been found. The pump 26 is preferably a kind of air pump or suction pump that is provided to influence the pressure conditions in the second supply line 9 in such a way that, for example, extinguishing fluid flows via the supply line 9 from a lower-lying lake or stream to the multi-port valve 10 (which may optionally also be located higher up). The pressure conditions in the second supply line 9 at the inlet to the multi-port valve 10 created by the pump 26 are used to trigger the switching operation of said multi-port valve. As a result, the control device can switch over automatically as soon as a local extinguishing fluid source 2 is found and connected to the fire extinguisher device.

As is further apparent from FIG. 2, the controller 11 is connected via control lines 12 to a radio device 13 in the region of the extinguisher nozzle 4, which radio device is connected to the control line 12. The control lines 12 can either be attached to the sheath of the hose 3 or be integrated into the wall of the hose. The control line 12 is preferably an electrical conductor for transmitting electrical signals, data and/or for supplying energy. The radio device is preferably a radio module for transmitting data between a transmitter and receiver over a short distance, such as WPAN or WLAN. This kind of radio transmission technology aims at preferably covering the working region around the radio device 13.

Furthermore, a radio device 14 to be carried by the firefighter operating the extinguisher nozzle 4, which radio device is capable of receiving the radio signals 15 emitted by the radio device 13 and displaying them in a display 16 to be carried by the firefighter operating the extinguisher nozzle 4, preferably in the form of a head-up display. This justifies only a very short transmission path of the data via radio directly in the working area of the firefighter, who, because of this, is substantially less susceptible to interference. In the embodiment of the present invention shown in FIG. 2, data is only transmitted in one direction, as illustrated by the direction arrow of the radio signals 15 that can be seen in FIG. 2.

If the display 16, as in FIG. 2, is designed as a head-up display in the helmet 6 of the firefighter, it provides particularly good viewing conditions for the firefighter during operations with respect to the information coming from the operations center, particularly under often difficult viewing conditions that are caused, for example, by poor lighting conditions, smoke, soot or the like.

To supply the radio device 13 with data, a battery (not shown) can be provided on the extinguisher nozzle 4 or in the region thereof. Alternatively, the radio device 13 can also be supplied with electrical energy via the control lines 12 or via additional electrical power-carrying lines (likewise not shown), which likewise run in or on the hose 3.

Preferably, the information shown in the display 16 can, preferably simultaneously, be shown in a display 17 of the fire extinguisher device or of the fire-fighting vehicle 1 such that the operator at the fire-fighting vehicle simultaneously sees the data or information being transmitted to the firefighter at the extinguisher nozzle 4.

Figure 3:
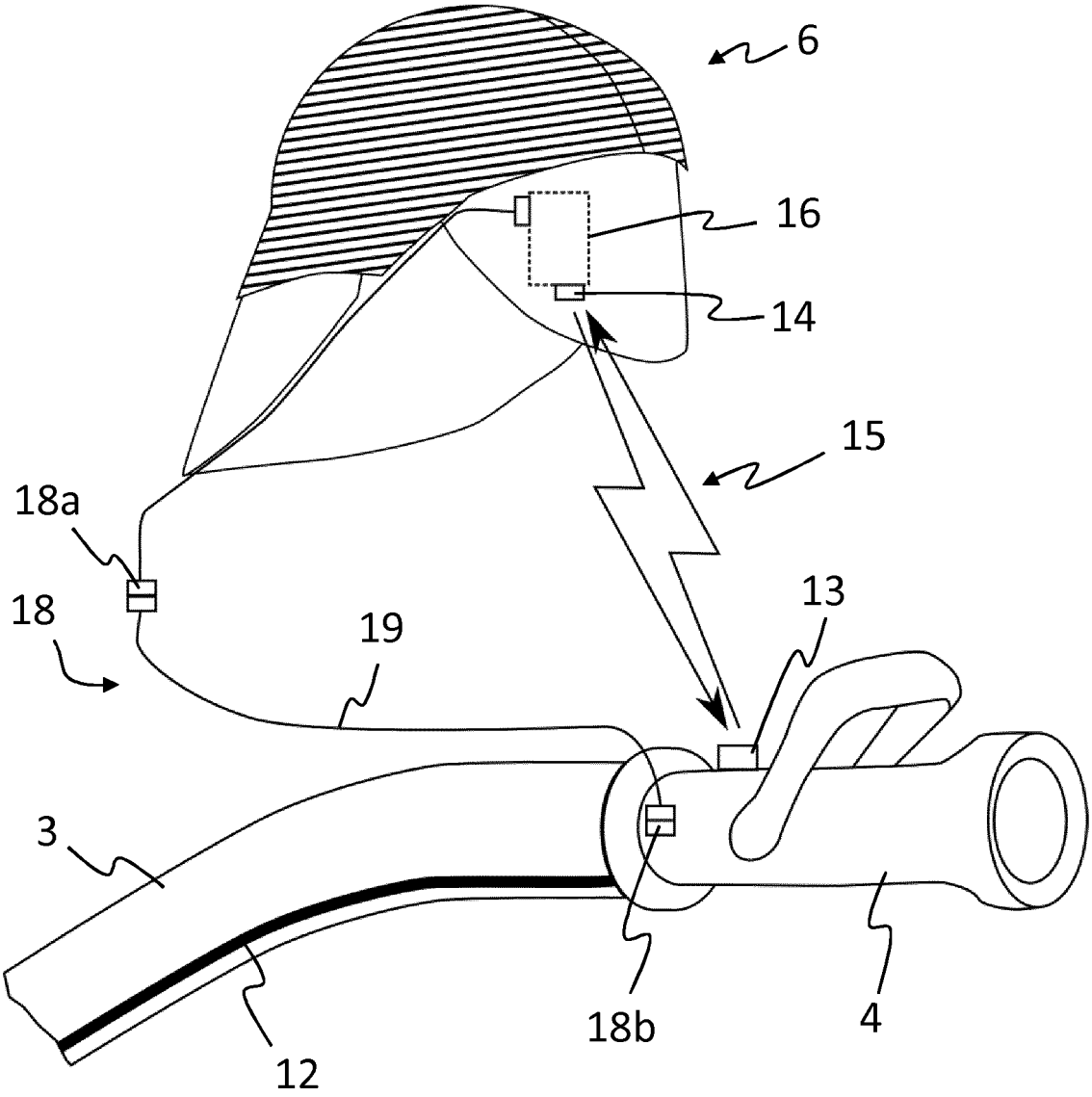
FIG. 3 shows a highly simplified schematic representation of the region of the communications bridge between the extinguisher nozzle and the display provided in the helmet of the firefighter.

FIG. 3 shows a further embodiment of the communications bridge between extinguisher nozzle 4 and display 16. In this case, a data interface 18 can additionally be provided, which data interface allows a cable connection to additionally be made from the control line 12 to the display 16. For this purpose, at least one, preferably two plug contact connections 18*a*, 18*b* can be provided as a data interface 18. The additional data interface 18 serves solely as a backup position for emergencies.

The display 16 provided in the helmet 6 of the firefighter as a head-up display is connected via an energy source (not shown in FIG. 3), for example a rechargeable battery. The radio transmission bridge in the region of the extinguisher nozzle 4, which radio transmission bridge is short according to the invention, allows the additional data transfer via a communication cable 19 to be provided as a backup position in a simple manner.

In a further embodiment, the invention additionally allows bidirectional data transmission to be established between the first and second radio devices 13 or 14. Preferably, in addition to data for the display 16, voice files can also be transmitted both from the firefighter operating the extinguisher nozzle 4 to the controller 11 and/or from the firefighter at the controller 11 to the firefighter at the extinguisher nozzle 4.

FIG. 4*a* shows the switching position of the multi-port valve 10 while the conveying pump 5 is being supplied with extinguishing fluid from the tank 8. The supply of extinguishing fluid from the tank 8 must be maintained until the conveying pump 5 can be supplied via a stationary extinguishing fluid source 2. This can be either a fixedly installed hydrant 28 or a lake 27 or a stream, river or the like.

If a hydrant 28 is available, the second supply line 9 of the conveying pump 5 is connected to the outlet of the hydrant 28. For example, extinguishing water from a hydrant has a pressure of approx. 3 bar. The extinguishing water will thus be present at this pressure at the multi-port valve 10 via the second supply line 9 after the hydrant 28 is opened. The pressure causes the multi-port valve 10 to switch from the switching position shown in FIG. 4*a* to the switching position shown in FIG. 4*b*. In this case, it may be, if necessary, expedient for the pump 26 to adjust the pressure created in the second supply line 9 to the required pressure or pressure range.

The pump 26 is, however, particularly important if no hydrant 28 but only a body of water, such as a lake 27, is available. It is often the case here that the water surface of the lake is lower than the fire-fighting vehicle 1 such that the pressure conditions in the second supply line 9 are affected by actuation of the pump 26 in such a way that the extinguishing water can reach the conveying pump 5 from the lake 27 via the multi-port valve 10.

For the pressure control 30 of the multi-port valve 10, an elastic element 25, for example a spring, can be provided, by means of which the multi-port valve 10 is held in the switching position shown in FIG. 4*a* in a pre-stressed manner. Alternatively or additionally, a magnetic element (not shown) can also be provided for the pressure control of the multi-port valve 10.

FIG. 5 shows the display 16, preferably a head-up display, in the helmet 6 of the firefighter. The following information can expediently be reproduced individually or in any combination via the display 16:

- the current filling level 20 of the tank 8 with extinguishing fluid,
- the remaining time 21 of the release of extinguishing fluid from the tank 8,
- status information 22 regarding the existence of a conveying connection of extinguishing fluid from the stationary extinguishing fluid source 2 to the fire extinguisher device,
- status information 22 regarding the non-existence of a conveying connection of extinguishing fluid from the stationary extinguishing fluid source 2 to the fire extinguisher device,
- status information 23 regarding the existence and/or non-existence of a radio connection and/or
- an alarm signal 24 and/or
- the switching position of the multi-port valve 10.

Reference is explicitly made to the fact that concepts according to the invention also comprise partial combinations of all of the above features.

LIST OF REFERENCE SIGNS

1 fire-fighting vehicle
2 stationary extinguishing fluid source
3 hose
4 extinguisher nozzle
5 conveying pump
6 helmet
7 first supply line
8 tank
9 second supply line
10 multi-port valve
11 controller
12 control line
13 first radio module
14 second radio module
15 radio signals
16 display
17 display
18 data interface
18*a* plug contact connection
18*b* plug contact connection
19 communication cable
20 current filling level
21 remaining time
22 status information for conveying connection
23 status information for radio connection
24 alarm signal
25 spring-loaded element
26 pump
27 lake
28 hydrant
29 conveying pump control
30 pressure control
31 valve
32 valve
33 return line
34 valve

The invention claimed is:

1. A control device for operating a fire extinguisher system of a fire-fighting vehicle, the fire extinguisher system comprising:

a controller adapted to function as an operations center;

at least one hose having an extinguisher nozzle arranged at an end of the hose by which a pressurized extinguishing fluid is released, a conveying pump for pressurized conveying of the extinguishing fluid in the hose toward the extinguisher nozzle, a first supply line to the conveying pump from a tank of a fire extinguisher device, a second supply line to the conveying pump from a stationary extinguishing fluid source, a multi-port valve connected upstream of the conveying pump, wherein the first supply line and the second supply line are connected to the multi-port valve, and the multi-port valve comprises a motor-driven pressure-controlled valve, wherein the multi-port valve switches at an adjustable pressure threshold, a second pump positioned in the second supply line between the stationary extinguishing fluid source and the multi-port valve, wherein in a first position of the multi-port valve, the conveying pump is connected to the tank, wherein the supply of extinguishing fluid from the tank is switched away from the tank and to the stationary extinguishing fluid source, if the pressure threshold is present at the multi-port valve in the second supply line, wherein pressure present at the multi-port valve in the second supply line can be defined with the second pump, and control lines connecting the multi-port valve to the controller.

2. The control device according to claim 1 wherein the multi-port valve is controlled via pressure present at the multi-port valve in the second supply line.

3. The control device according to claim 1, further comprising a flow connection between the tank and the pump in a loaded state of the multi-port valve.

4. The control device according to claim 1, wherein a switching position of the multi-port valve is displayed.

5. The control device according to claim 1, wherein the multi-port valve is a switch valve.

* * * * *